United States Patent [19]

Stahlecker et al.

[11] Patent Number: 4,495,758

[45] Date of Patent: Jan. 29, 1985

[54] APPARATUS AND METHOD FOR FORMING A WRAPPED YARN

[75] Inventors: Fritz Stahlecker, Bad Ueberkingen; Hans Braxmeier, Suessen, both of both of Fed. Rep. of Germany

[73] Assignees: Fritz Stahlecker; Hans Stahlecker, both of ; DEX

[21] Appl. No.: 491,021

[22] Filed: May 3, 1983

[30] Foreign Application Priority Data

May 5, 1982 [DE] Fed. Rep. of Germany ..... 3216749

[51] Int. Cl.[3] ..... D01H 13/22; D01H 13/16

[52] U.S. Cl. ..... 57/19; 57/78; 57/80; 57/87

[58] Field of Search ..... 57/3, 6, 18, 19, 264; 57/78, 80, 83, 84, 85, 86, 87, 88

[56] References Cited

U.S. PATENT DOCUMENTS

| | | | |
|---|---|---|---|
| 2,023,407 | 12/1935 | Cobb | 57/19 |
| 3,251,180 | 5/1966 | Klein | 57/89 |
| 3,681,909 | 8/1972 | Konstanovich et al. | 57/18 X |
| 4,213,290 | 7/1980 | Küpper | 57/87 X |
| 4,362,009 | 12/1982 | Rice | 57/80 X |
| 4,375,149 | 3/1983 | Hartsmannsgruber | 57/80 X |
| 4,389,837 | 6/1983 | Stahlecker et al. | 57/19 X |

*Primary Examiner*—Donald Watkins

*Attorney, Agent, or Firm*—Bell, Seltzer, Park & Gibson

[57] ABSTRACT

A wrapped yarn forming apparatus is disclosed, which is adapted to form a wrapped yarn composed of a core strand, such as a yarn sliver, and a binder strand which is spirally wrapped about the core strand. The apparatus includes a hollow spindle adapted to coaxially mount a supply package of the binder strand, yarn feed means for advancing the core strand through the spindle, and yarn take-up means for winding the resulting wrapped yarn into a package. In the event of yarn breakage, means are provided for interrupting the drives of the various components, and also for terminating the continued withdrawal of the binder strand from its supply package and the continued wind-up of such strand on the take-up package, which would normally occur where only the core strand is broken. Thus piece-up of the apparatus is facilitated by avoiding the necessity of removing the wound binder strand from the take-up package.

25 Claims, 9 Drawing Figures

18
71
3
19
41
83
47
48
C
80
81
82
70
49
20
58
68
69
40
84

18
71
3
19
B
41
83
47
48
80
81
82
20
70
49
58
69
68
40
84

APPARATUS AND METHOD FOR FORMING A WRAPPED YARN

The present invention relates to an apparatus and method for forming a wrapped yarn of the type composed of a core strand having a binder strand spirally wrapped thereabout.

Known wrapped yarn spinning machines typically comprise an initial feed system for the to-be-wrapped core strand, a hollow spindle which coaxially mounts a supply package of the binder strand, a pair of delivery feed rolls mounted downstream of the spindle and consisting of a driven roll and a pressure roll, and a downstream take-up winder for winding the resulting wrapped yarn into a package. A drive system is also provided for the initial feed system, the hollow spindle, the delivery feed rolls, and the take-up winder. Further, a yarn monitoring system may be included which stops the delivery of the to-be-wrapped core strand to the hollow spindle, and which also stops the drive of the downstream components, upon detection of an interruption in the spinning operation.

In a wrapped yarn spinning apparatus of the above described type (note German Offenlegungsschrift No. 30 22 149) the drives are stopped and the delivery of the to-be-wrapped core strand is terminated upon only one of the yarn components being broken. Where only the core strand is down, the binder strand will remain unbroken between its supply package and the take-up package, and since the take-up package will continue to rotate from its inertia, particularly where the package is relatively large, the binder strand will continue to be withdrawn from its supply package and wound onto the take-up package for a considerable period of time. When the broken component is pieced up, this wound length of the binder strand must be removed from the take-up package, which can be a troublesome and time consuming process, and in any event delays the piece-up procedure.

It is accordingly an object of the present invention to provide an apparatus and method for forming a wrapped yarn which simplifies the piece-up procedure when only the to-be-wrapped core strand is broken.

This and other objects and advantages of the present invention are achieved in the embodiments illustrated herein by the provision of an apparatus which includes means for advancing the core strand along a path of travel, means for withdrawing a binder strand from its supply package and spirally wrapping the same about the advancing core strand, means for monitoring the advancing wrapped yarn to detect breakage of at least the core strand, and means for terminating the advance of the core strand and terminating the withdrawal of the binder strand from its supply package upon detection of the breakage of at least the core strand.

The above structural features assure that in the event of a breakage of the to-be-wrapped core strand, the binder strand will no longer be withdrawn from its supply package and wound onto the take-up package, so that it is no longer necessary to remove the binder strand which has been wound onto the take-up package.

In one advantageous embodiment of the present invention, the means for terminating the withdrawal of the binder strand includes an attachment mounted to one of the structural parts which are moved to effect interruption of the drive of the various components, and with the attachment being adapted to effectively act on the binder strand upon the movement of such structural part. This arrangement for preventing the further withdrawal of the binder strand consists of only a few additional parts, and does not require its own adjusting mechanism or drive. In another embodiment having the same advantages, the attachment is fixedly positioned in the path of travel of one of the structural parts as it moves during interruption of the drives, and such structural part and/or the binder strand comes into operative contact with the attachment when the drives are stopped.

Some of the objects of the invention having been stated, other objects and advantages will become apparent as the description proceeds, when taken in connection with the accompanying drawings, in which FIG. 1 is a schematic illustration of a wrapped yarn forming apparatus in its operational position, and which embodies the features of the present invention;

Figure 1:
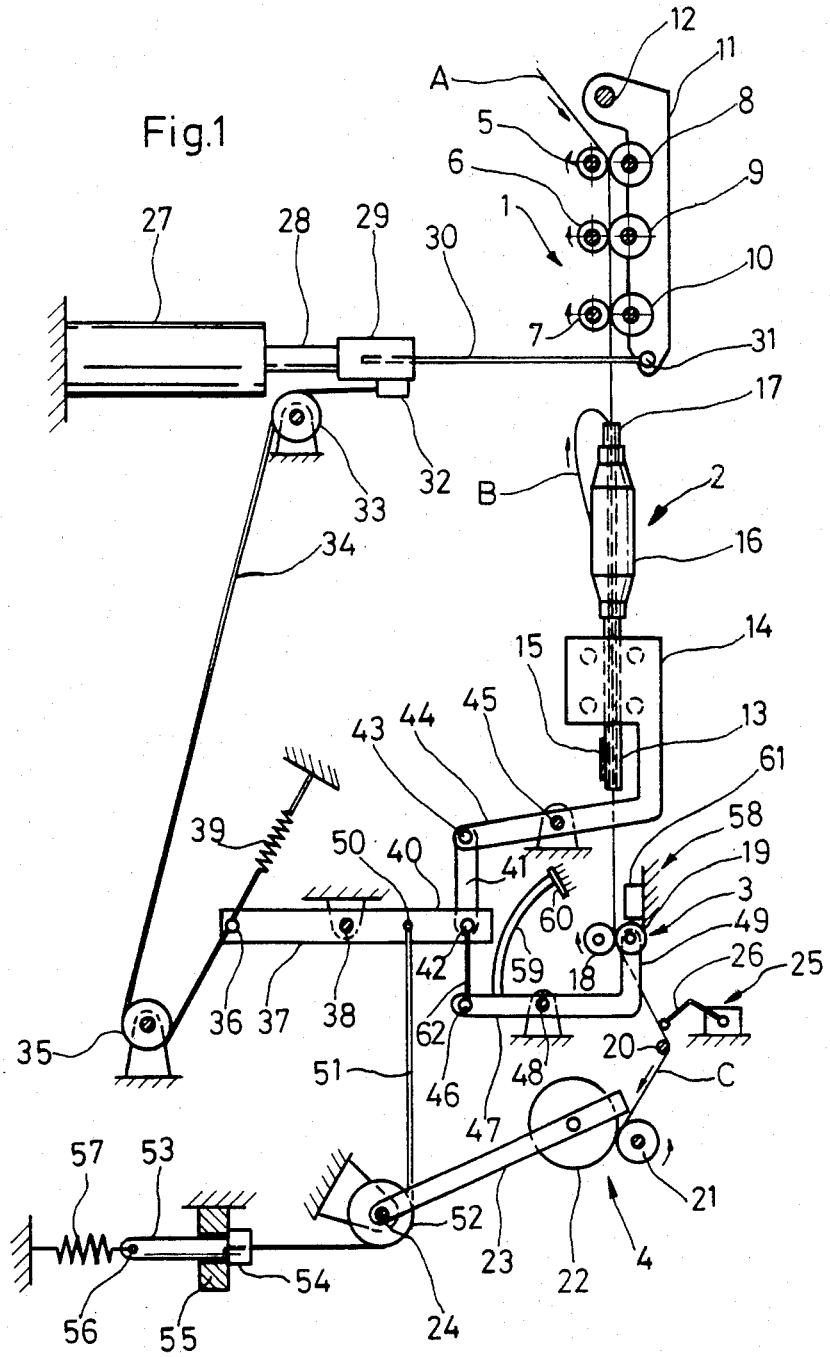

Referring more particularly to the drawings, FIG. 1 illustrates one yarn forming position of a wrapped yarn forming machine, and it will be understood that the machine will normally include a large number of such positions disposed in a side-by-side arrangement along the length of the machine. At each position, there is provided a yarn forming apparatus which includes a drafting system 1, a spindle assembly 2, a pair of delivery rolls 3, and a take-up winder 4.

The drafting system 1 contains three bottom rolls 5, 6, and 7 which extend along the length of the machine and are driven from a motor drive section located at one end of the machine. Depending on the application, the number of these rolls may vary. Three cooperating top rolls 8, 9, and 10 are associated with respective ones of the bottom rolls, with the top rolls preferably extending only over one yarn forming position. The tops rolls are rotatably mounted on a weighted arm 11, which in turn is adapted to pivot about a stationary shaft 12. The pressure rolls 8, 9 and 10 are preferably pressed against the driven bottom rolls 5, 6 and 7 by the action of springs (not shown). It is further provided that each successive pair of rolls rotates faster than the preceding pair, so that a core strand A, which may for example be composed of a sliver of staple fibers, and which is supplied to the first pair of rolls 5, 8 in the direction of the arrow, is drawn by the subsequent pairs of rolls.

The spindle assembly 2 is mounted downstream of the drafting system 1, and includes a hollow spindle 13 which is rotatably mounted in a bearing housing 14 and driven by a tangential belt 15 which extends along the length of the entire machine and is driven from the end of the machine. A supply package 16 of the binder strand B is coaxially mounted on the spindle 13, and is non-rotatably joined to the spindle so that the package rotates with the spindle. The upstream end of the spindle 13 is designed as a twist inserter 17, which is further described below. The bearing housing 14, together with the spindle 13 and the supply package 16, are adapted to swing downwardly by the pivotal movement of the housing about a shaft 45 which is fixedly mounted on the machine frame. This pivotal mounting serves to interupt the drive of the spindle by separating the spindle from the drive belt 15, note FIG. 2.

The pair of delivery rolls 3 are mounted downstream of the spindle assembly 2, and comprises a drive roll 18 extending along the length of the entire machine and connected to a suitable drive at the end of the machine. A pressure roll 19 is associated with the drive roll 18 to each yarn forming position, and in the operating position, the pressure roll 19 contacts the drive roll 18. Further, the pressure roll 19 is adapted to swing away from the drive roll 18 in a clockwise direction by the actuation of a lever 47, 49, which in turn is pivotally mounted about a stationary shaft 48. The lever 47, 49 is generally L-shaped to define two arms, with the arm 47 being disposed on the opposite side of the shaft 48 from the roll 19.

The take-up winder 4 is positioned downstream of the pair of delivery rolls 3, and includes a grooved roll 21 which serves to traverse the wrapped yarn C to form the take-up package 22. The grooved roll 21 is mounted on a shaft extending along the length of the entire machine, and is connected to a drive at the end of the machine. In its operating position, the grooved roll 21 is biased into contact with the take-up package 22 by a spring or the like (not shown). The take-up package 22 is rotatably mounted at the end of the bracket 23, and for the purpose of doffing or interrupting the drive, the bracket 23 may be pivoted about a stationary shaft 24.

Referring again to FIG. 1 which illustrates the operating position of the apparatus, the drafting system 1 will be seen to advance the core strand A into the hollow spindle 13. Strand A first travels through the twist inserter 17 and then moves essentially twist free through the spindle 13. The binder strand B is withdrawn from the supply package 16 located on the spindle 13, and is also directed through the twist inserter 17 and through the hollow spindle 13. Due to the rotation of the supply package 16, the binder strand B is wrapped around the advancing core strand A and binds the core strand with spiral wrappings. The resulting wrapped yarn C exits from the spindle 13, and is drawn off by the pair of delivery rolls 3. The yarn C is then delivered to the take-up winder 4.

A yarn monitoring device 25 is provided immediately downstream of the delivery rolls 3, and is adapted to monitor the tension of the wrapped yarn C, with the breakage of only one component being registrable due to a change of the tension. The yarn monitoring device 25 comprises a yarn sensor 26 which rests with a slight pressure against the advancing wrapped yarn C. A deflecting rod 20 is provided in the area of the yarn monitoring device 25.

The breakage of only one yarn strand A or B will be detected by the yarn monitoring device 25, and all drives may be stopped by pivotally moving individual elements. In this regard, a mechanical actuation mechanism is provided which preferably includes a pneumatic drive cylinder 27. The drive cylinder 27 is preferably actuated by a valve (not shown) such as an electromagnetic valve, which controls a pressure medium in accordance with the desired direction of movement. The electromagnetic valve may be electrically controlled by the yarn monitoring device 25.

The drive cylinder 27 is fixedly mounted on the frame of the machine, and it includes a piston 28 which is equipped with a tensioning member 29 which in turn mounts a leaf spring 30. The free end of the leaf spring 30 is pivoted to the free end of the weighted arm 11 of the drafting system 1 at a pivot point 31. The leaf spring is mounted laterally of the pressure roll 10, and is sufficiently rigid so as to be able to transmit the longitudinal force which is necessary to pivot the weighted arm 11. The leaf spring is sufficiently flexible in the lateral direction so that it can accommodate the difference between the linear movement of the piston 28 and the arcuate movement of the pivot point 31.

A holding element 32 is attached to the piston 28, or the tensioning member 29, for supporting the end of a cable 34. The cable 34 travels downwardly over a first stationary pulley 33 located in the area of the drive cylinder 27, and is then guided over a second stationary pulley 35 and returns upwardly. It is then pivotally connected at point 36 of a two-arm intermediate lever 37, 40 which pivots about a stationary shaft 38. A spring 39 tensions the cable 34 and is connected to the arm 37 at the pivot point 36.

A guide arm 41 is pivotally connected to the arm 40 of the intermediate lever at pivot point 42, and the opposite end of the arm 41 is connected to a further two-arm lever 44 at pivot point 43. The lever 44 pivots about a shaft 45 which is parallel to the shaft 38. The other arm of this two arm lever 44 mounts the bearing housing 14 of the spindle assembly 2.

A further guide arm 62 is connected to the pivot point 42 of the arm 40 and extends in a direction opposite to that of the guide arm 41. The guide arm 62 may, for example, comprise a leaf spring, and it is pivotally connected to the arm 47 of the two-arm lever 47,49 at pivot point 46. The two arm lever 47,49 is adapted to pivot about a shaft 48 which is parallel to shafts 38 and 45, and it also mounts the non-driven delivery roll 19 on its arm 49. Thus, the two lever arms 44 and 47 move in the same direction when the intermediate lever 37,40 is displaced.

Another traction cable 51 is pivotally connected to the arm 40 of the two arm lever 37,40, and is tensioned by a spring 57 which is connected to the machine frame. Tensioning cable 51 is guided over a pulley 52, which is non-rotatably connected with the bracket 23 which rotatably mounts the take-up package 22, and with the package 22 being arranged coaxially to the pivot shaft 24. A pin 53 is positioned between the tension spring 57 and the cable 51, with the pin being movable in a guide 55. One end of the pin has an attachment means 56 for the spring 57. On the side of the guide 55 facing opposite the spring 57, the pin 53 is provided with a head or collar 54, which limits the movement of the pin 53 and thus also the movement of the traction cable 51. The position of the guide 55 and the head 54 is selected so that in the operating position (FIG. 1), the head 54 rests against the guide so that the cable 51 is loosely entrained over the pulley 52, and no force is transmitted from the cable 51 to the pulley 52. The bracket 23 is preferably biased by a spring (not shown) in a direction toward the drive roll 21, and thus it is freely movable in the operating position so that it can adapt its position to the increasing diameter of the take-up package 22.

To shut down the yarn forming apparatus, the piston 28 of the working cylinder 27 moves outwardly by the application of a corresponding pressure medium (note FIG. 2), and the piston 28 acts through the leaf spring 30 to pivot the weighted arm 11 away from the bottom rolls 5,6 and 7. Concurrently, the piston 28 displaces lever arm 44 via the traction cable 34, lever 37, 40, and the arm 41, so that the spindle 13 is separated from the tangential belt 15. In addition, the lever 47, 49 is pivoted so that the non-driven roll 19 is separated from the driving roll 18. Further, the bracket 23 for the take-up package 22 is pivoted so as to lift the package 22 from the driving roll 21. To the extent the intermediate lever 37, 40 moves in the direction of the shut down position, the cable 51 is tensioned by the force of the spring 57 and frictionally contacts the pulley 52 by reason of this tension. The resulting friction from the looping angle, which is about 90 degrees in the illustrated embodiment, between the pulley 52 and cable 51, exerts an entraining force on the pulley which pivots the bracket 23 and the package 22. The final position of the bracket 23 is variable according to the initial position of the bracket, which in turn is dependent on the diameter of the wound package 22.

Figure 2:
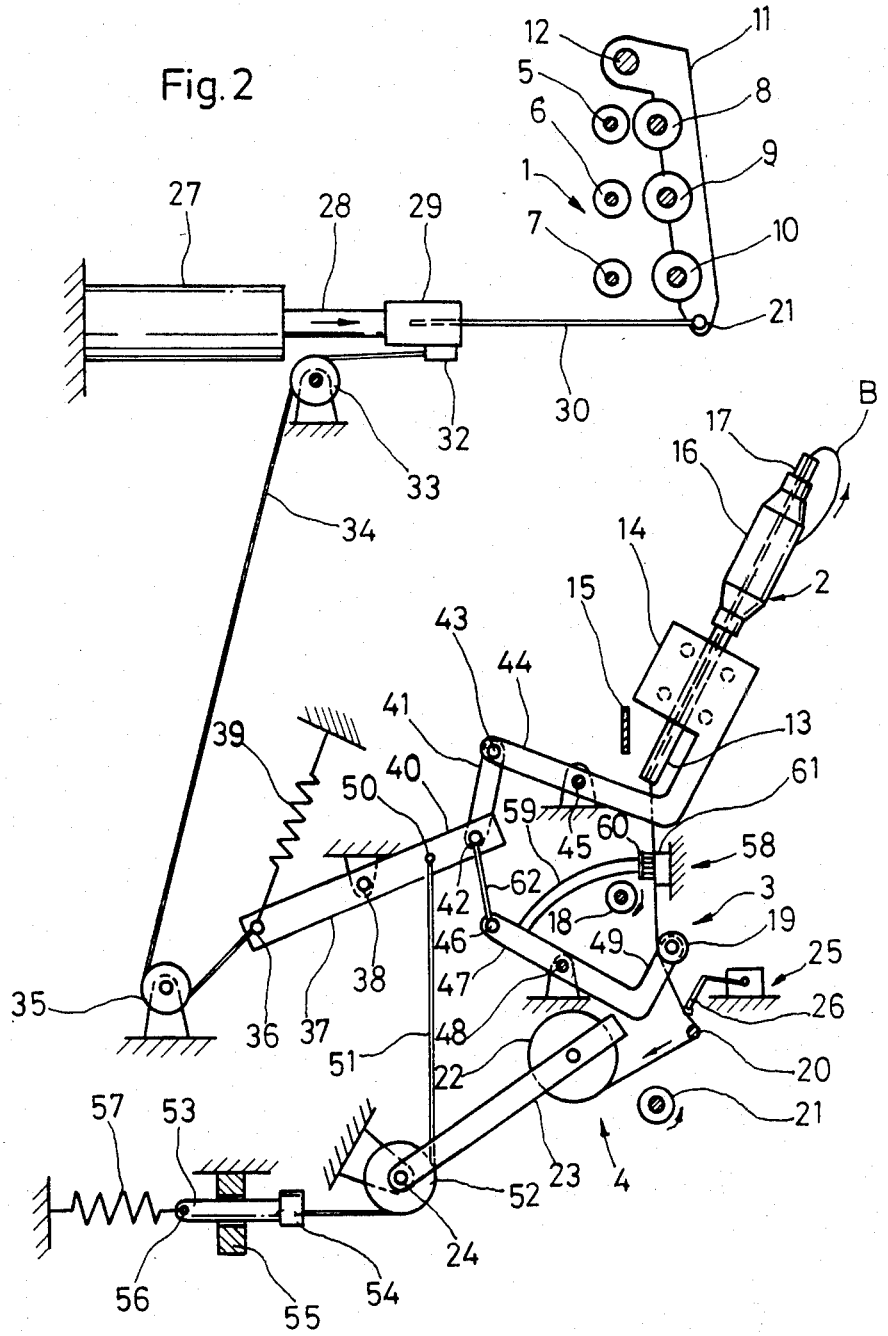
FIG. 2 is a view similar to FIG. 1, but illustrating the apparatus in its non-operative position.

To restore the apparatus to its operating position, the piston 28 moves from its position shown in FIG. 2 back into the drive cylinder 27, thereby returning the weighted arm 11 with the top rolls 8, 9, and 10 resiliently held therein, into contact with the bottom rolls 5, 6, and 7. The operating position is thus secured by the drive cylinder 27. Tension spring 39 causes the intermediate lever 37, 40 to return to its operating position as shown in FIG. 1, and wherein the spindle 13 is brought back into contact with the tangential belt 15. Also, the non-driven pressure roll 19 is returned to the driven roll 18, and the take-up package 22 is returned to its driving roll 21. The latter movement occurs by reason of the entraining force of the spring 57 which is operative until the head 54 contacts the guide 55.

As noted above, the yarn monitoring device 25 registers a breakdown and activates the interruption of the drives, when only strand A is broken. In such event, the supply from the drafting system 1, as well as the drives of the spindle 13, delivery rolls 3, and take-up system 4 are stopped, without effecting the adjacent yarn forming positions on the machine. By reason of its inertia, particularly at large package diameters, the take-up package 22 will continue to rotate for a given period of time, after it has been lifted from the driving roll 21. As it does so, it continues to withdraw a substantial length of the binder strand B from the supply package 16, and to wind the same onto the package 22.

In the embodiment of FIGS. 1 and 2, there is further provided an attachment 58 which serves to immediately terminate the withdrawal of the binder strand B from the supply package 16 when the yarn forming apparatus is shut down. The attachment 58 comprises a comb or brush-like clamping element 60, which is carried by the curved lever 59 which in turn is attached to the lever arm 47. Thus the element 60 is moved concurrently with the movement of the lever arm 47, which also serves to separate the pressure roll 19 from the driven roll 18. In the event of a breakdown, the comb or brush-like clamping element 60 moves against a preferably elastic base 61 located in the area of the delivery rolls 3. Thus the clamping element 60 acts to clamp the binder strand B, provided the same has not as yet broken. The continued rotation of the take-up package 22 after it has been lifted from the driving roll 21, usually causes the binder strand B to break, so that any additional withdrawal of the binder strand from the supply package 16 is stopped.

As an alternative to the brush-like clamping element 60 and the elastic base 61, blade-like severing elements may be provided which are designed to cut the binder strand B upon breakdown. For example, a blade may be arranged in place of the base 61, against which the binder strand is directed by element 60, which then may be designed and constructed as a simple deflecting element for the binder strand.

The following further embodiments of the attachment 58 for terminating the withdrawal of the binder strand B may be provided on a wrapped yarn forming apparatus as shown in FIGS. 1 and 2, with the above described attachment 58 being omitted. Therefore, in the remaining description, the structural parts have the same numerals as are used for the corresponding structural parts in FIGS. 1 and 2.

Figure 3:
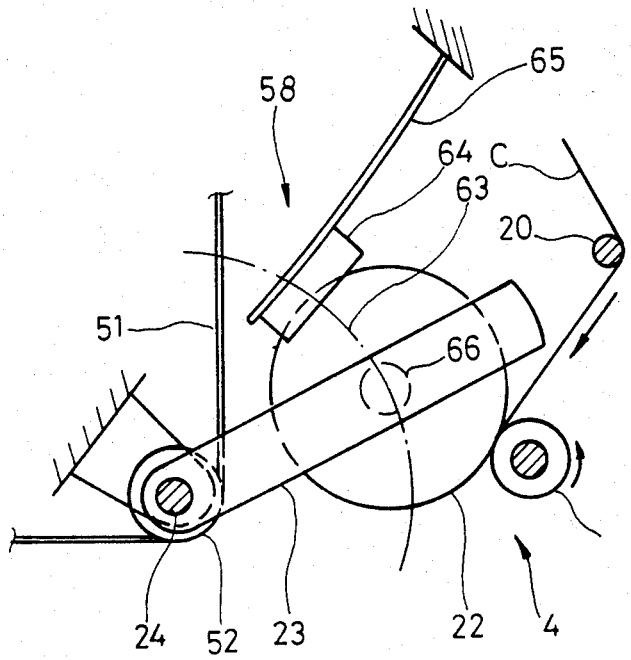
FIG. 3 is a fragmentary schematic view of the take-up winder of a yarn forming apparatus of the type shown in FIGS. 1 and 2, and illustrating a take-up package brake in its non-operative position.
Figure 4:
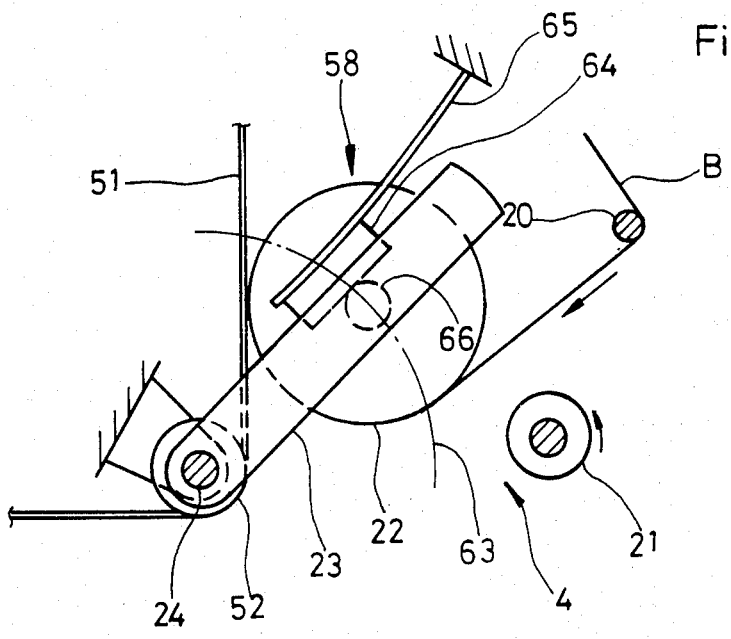
FIG. 4 is a view similar to FIG. 3, but illustrating the package operatively contacting the brake.

In the embodiment illustrated in FIGS. 3 and 4, the attachment 58 is designed and constructed as a brake, which stops rotation of the take-up package 22 when the drive of the take-up system 4 is terminated. The brake consists of a fixedly mounted leaf spring 65 which is provided with a brake pad 64, against which the winding tube 66 of the package 22 is moved when the package mounting bracket 23 is lifted. The brake pad 64 is disposed laterally of the wound package and so as to engage the tube 66, which normally is not wound over its entire length so that there is adequate space for the brake pad 64. This embodiment is advantageous in that the binder strand B is not cut when only the core strand A is down, so that, where necessary, the yarn may be easily returned through the hollow spindle 13 without the use of tools.

Figure 5:
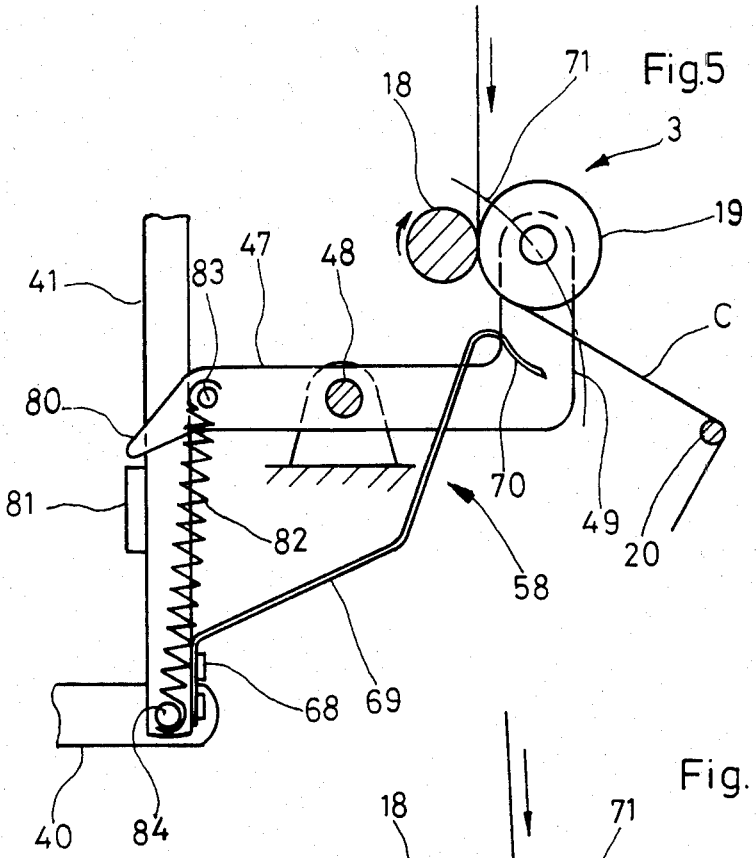
FIG. 5 is a fragmentary schematic view of the delivery rolls of a yarn forming apparatus of the type shown in FIGS. 1 and 2, and illustrating a yarn clamping device disposed adjacent the delivery rolls.
Figure 6:
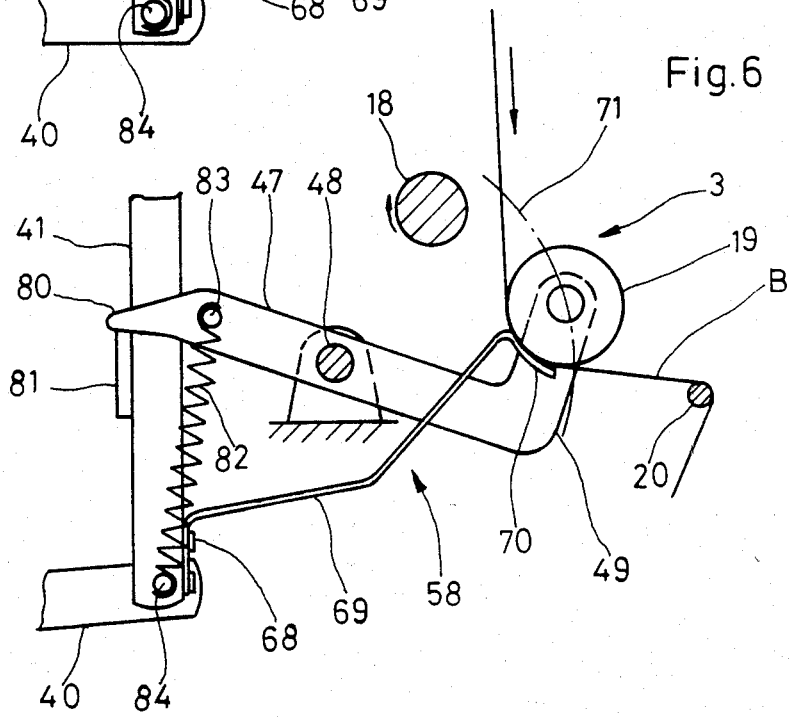
FIG. 6 is a view similar to FIG. 5 and illustrating one of the delivery rolls operatively engaging the clamping device.

In the embodiment illustrated in FIGS. 5 and 6, the attachment 58 is associated with the pair of delivery rolls 3, and is designed and constructed as a clamping device which is moved toward the pressure roll 19 when the drive is interrupted, and so as to press the binder strand B against the circumference of the roll 19. In order to move the clamping device and pressure roll 19 toward each other, the lever mechanism is somewhat modified, in that the two arm lever 47,49 is no longer operatively connected with the intermediate lever 37, 40 by a guide arm 62 as shown in FIGS. 1 and 2. Rather, a tension spring 82 is provided, which is pivotally connected to a pin 83 of arm 47 and to a pin 84 of arm 40 of the intermediate lever 37, 40. The pin 84 also forms a connection between the intermediate lever 37, 40 and guide arm 41, which is a part of the pivoting mechanism for the spindle assembly 2. A stop plate 81 is attached to the guide arm 41, and is associated with a stop 80 on the lever 47.

To describe the operation of the embodiment of FIGS. 5 and 6, it will be seen that when the drives, and in particular the drive of the delivery rolls 3, are interrupted, the stop plate 81 moves against the stop 80 from below, and then displaces the lever 47,49 against the force of the spring 82, so that the pressure roll 19 is moved away from the driven delivery roll 18. The lever 47,49, and thus the pressure roll 19, are returned by the force of the spring 82 when the stop 81 is subsequently lowered. In addition, the curved leaf spring 69 is attached by screws 68 to the guide arm 41 in the area of the pin 84, and the end of the spring is curved at 70 to accommodate the pressure roll 19. The radius of curvature at 70 is somewhat greater than that of the pressure roll 19.

As soon as the guide arm 41 is raised, the end 70 of the leaf spring 69 moves toward pressure roll 19, and the roll 19 is displaced in a direction toward the end 70 when the stop plate 81 contacts the stop 80 of the arm 47. The end 70 of the leaf spring 69 is then positioned in the area of the pressure roll 19 which guides the binder strand B, so that the component is clamped between the pressure roll 19 and the end 70, and the leaf spring 69 is elastically deformed. With the binder strand B thus clamped, any further withdrawal from the supply package 16 is prevented. If the strength of the binder strand B is sufficient to stop rotation of the take-up package 22, the strand B will not be broken. However, with a large package diameter, it may be expected that the strand B will separate in the area between the pressure roll 19 and the take-up package 22. The end of the strand B remaining in the spindle 13 may, under certain circumstances, be used for returning the wrapped yarn C.

Figure 7:
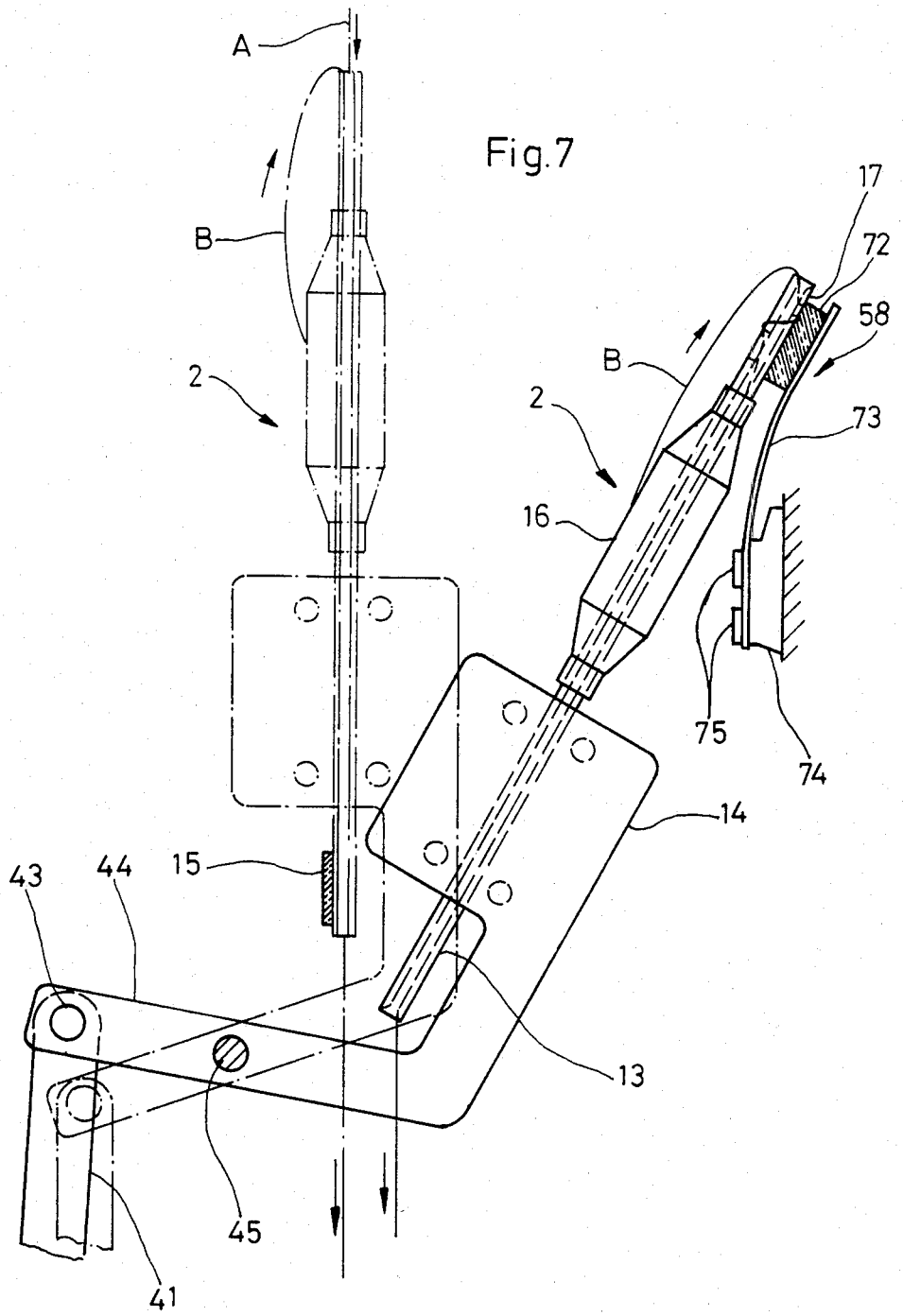
FIG. 7 is a fragmentary schematic view of the hollow spindle of a yarn forming apparatus of the type shown in FIGS. 1 and 2, with its operating position being illustrated in broken lines and its non-operative position being illustrated in solid lines.

In the embodiment of FIG. 7, the attachment 58 is again a clamping device, which is directly associated with the hollow spindle assembly 2. The upstream or entry end of the spindle 13 is provided with a twist inserter 17, consisting of two axially displaced, radial openings. The core strand A and binder strand B both enter into the axial bore of the spindle 13. They then leave the spindle 13 through the first transverse opening, and after having been looped by about 180 degrees, they re-enter into the axial bore of the spindle through the second transverse opening. The clamping device is positioned so that it is associated with the spindle in the area where the binder strand B travels on the exterior of the spindle when a break of the strand A occurs. In this embodiment, the clamping device comprises a leaf spring 73, which is attached by means of a holder 74 to the machine frame, and which carries an elastic clamping pad 72 at its free end. This clamping pad 72, which may comprise a rubber elastic material, is located in the path which the twist inserter 17 of the spindle travels when it is separated from the tangential belt 15, so that the binder strand B is clamped and a further withdrawal of the same is effectively precluded.

Figure 8:
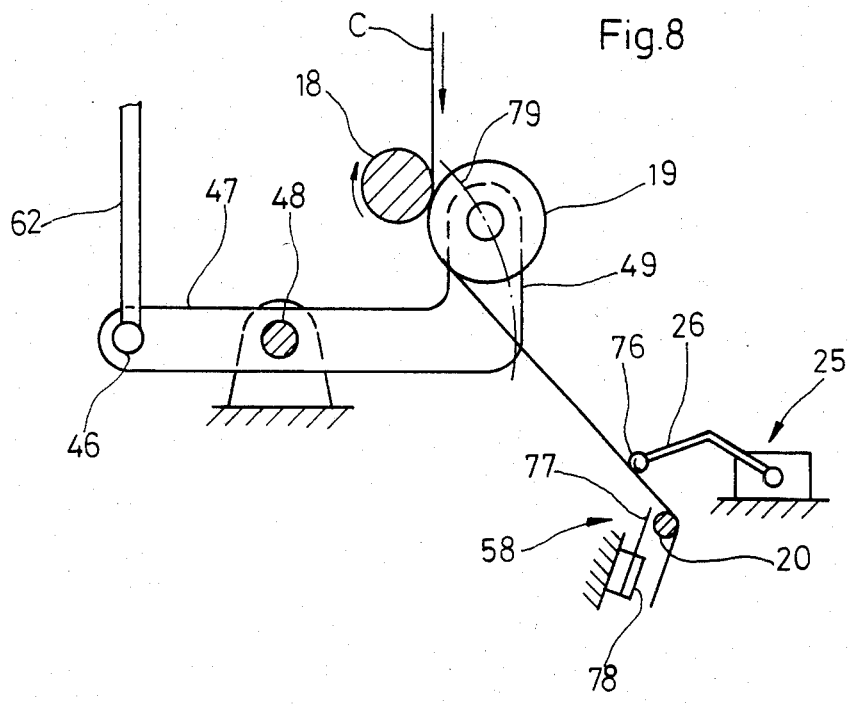
FIG. 8 is a fragmentary schematic view of a yarn monitoring device on a yarn forming apparatus of the type shown in FIGS. 1 and 2, and illustrating the normal operating position of the components.
Figure 9:
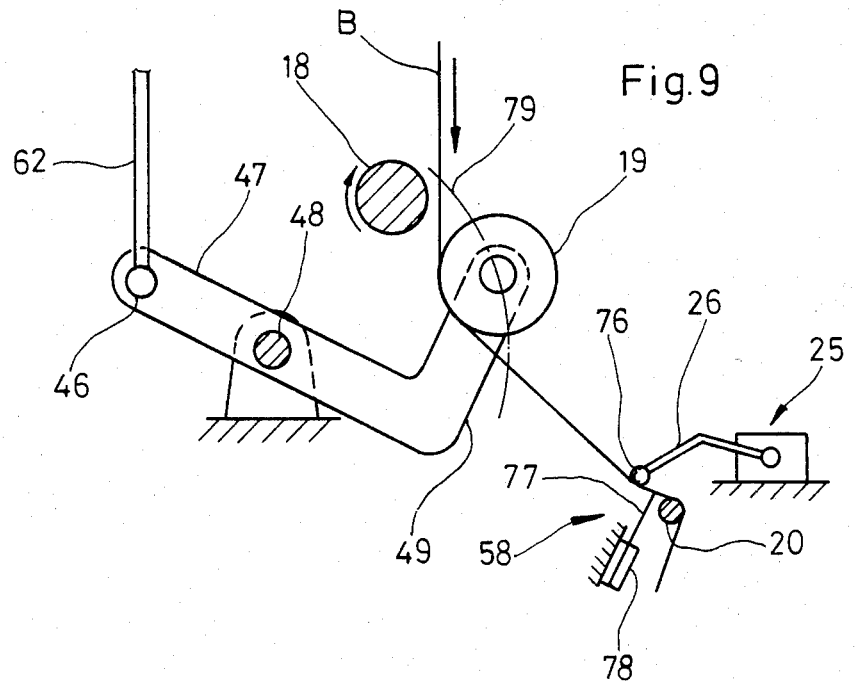
FIG. 9 is a view similar to FIG. 8 and illustrating the position of the components in the non-operative position of the apparatus.

In the embodiment of FIGS. 8 and 9, the attachment 58 is in the form of a severing device which cuts the strand B when the strand A breaks, and when the individual elements are moved to their shutdown position. This severing device is positioned upstream of the take-up winder 4, and it comprises a cutting blade 77 fixed to the machine frame, and with the blade being arranged in the area of the yarn monitoring device 25 adjacent the normal yarn path of travel and the deflecting rod 20. The yarn monitoring device 25 includes a yarn sensor 26, which rests with its contact end 76 against the wrapped yarn C under a slight tension. The sensor 26 is held in the operating position shown in FIG. 8 by the tension of the wrapped yarn C between the take-up winder 4 and the delivery system 3. In the absence of core strand A, the tension remaining in binder strand B decreases, so that the yarn sensor 26 is moved and thus activates the monitoring device 25. At the same time, the end 76 of the sensor 26 deflects the binder strand B to the extent that it engages the blade 77, and the strand is cut. Thus the strand B will no longer be withdrawn by the takeup package 22, as it continues to rotate.

In the drawings and specification, there has been set forth preferred embodiments of the invention, and although specific terms are employed, they are used in a generic and descriptive sense only and not for purposes of limitation.

That which is claimed is:

1. A yarn forming apparatus adapted to form a wrapped yarn composed of a core strand having a binder strand spirally wrapped thereabout, and comprising means for advancing a core strand along a path of travel and to a rotating take-up package, means for withdrawing a binder strand from a supply package and spirally wrapping the same about the advancing core strand to form a wrapped yarn, monitoring means for detecting a break in at least the core strand, and control means responsive to said monitoring means detecting a break in the core strand for terminating the advance of the core strand and including means for positively terminating the withdrawal of the binder strand from its supply package, so as to avoid undue winding of the binder strand on the take-up package.

2. The yarn forming apparatus as defined in claim 1 wherein said control means includes means for physically engaging the binder strand to preclude movement thereof.

3. The yarn forming apparatus as defined in claim 1 wherein said control means includes means for severing the binder strand.

4. The yarn forming apparatus as defined in claim 1 wherein said control means includes means for braking the take-up package so as to terminate the rotation thereof.

5. The yarn forming apparatus as defined in claim 1 further comprising means for drafting the core strand to reduce the density thereof as it advances along said path of travel prior to its having the binder strand wrapped thereabout.

6. A yarn forming apparatus adapted to form a wrapped yarn composed of a core strand having a binder strand spirally wrapped thereabout, and comprising a frame, a spindle assembly including a hollow spindle rotatably mounted to said frame, with said spindle being adapted to coaxially mount a supply package of the binder strand and so that the supply package rotates with the hollow spindle, yarn feed means mounted to said frame for advancing the core strand through the hollow spindle, yarn take-up means mounted to said frame downstream of said spindle for winding an advancing yarn into a yarn take-up package, drive means for rotating said hollow spindle and operatively driving said yarn feed means and said yarn take-up means, and such that the binder strand may be withdrawn from the rotating supply package and guided through the rotating hollow spindle so as to be spirally wrapped about the advancing core strand to form a wrapped yarn which is then wound onto the yarn take-up package, monitoring means for detecting a break in at least said core strand, and control means responsive to said monitoring means detecting a break in the core strand for terminating operation of said drive means and including means for positively terminating the withdrawal of the binder strand from the supply package, and so as to avoid undue winding of the binder strand onto the take-up package.

7. The yarn forming apparatus as defined in claim 6 wherein said drive means includes a drive belt, and wherein said spindle assembly further comprises a housing rotatably mounting said hollow spindle, with said housing being pivotally mounted to said frame for selective pivotal movement about an axis generally perpendicular to the axis of said hollow spindle and so that the hollow spindle may be selectively pivoted between an operative position engaging said drive belt and a non-operative position separated from said drive belt.

8. The yarn forming apparatus as defined in claim 7 wherein said yarn feed means comprises at least one cooperating pair of feed rolls mounted to said frame upstream of said spindle, and at least one cooperating pair of feed rolls mounted to said frame downstream of said spindle, and means pivotally mounting at least one of each of said cooperating pairs of feed rolls for selective movement between a contiguous operative position and a separated, non-operative position.

9. The yarn forming apparatus as defined in claim 8 wherein said yarn take-up means comprises bracket means rotatably mounting a yarn take-up package, a drive roll adapted to contact the surface of the yarn package, and means pivotally mounting at least one of said bracket means and said drive roll for selective movement between a contiguous operative position and a separated, non-operative position.

10. The yarn forming apparatus as defined in claim 9 wherein said control means includes means for concurrently pivoting each of said housing for said hollow spindle, said yarn feed means, and said yarn take-up means between their respective operative and non-operative positions.

11. The yarn forming apparatus as defined in claim 10 wherein said control means further includes attachment means affixed to one of said spindle assembly, said yarn feed means, and said yarn take-up means for physically engaging the binder strand upon pivotal movement to the non-operative position.

12. The yarn forming apparatus as defined in claim 10 wherein said control means further includes attachment means fixedly mounted on said frame in a position to be engaged by one of said spindle assembly, said yarn feed means, and said yarn take-up means for effecting interruption of the withdrawal of the binder strand upon pivotal movement to the non-operative position.

13. The yarn forming apparatus as defined in claim 12 wherein said attachment means comprises a brake pad positioned to operatively engage said hollow spindle upon its pivotal movement to its non-operative position.

14. The yarn forming apparatus as defined in claim 11 or 12 wherein said attachment means comprises means for clampingly engaging the binder strand upon pivotal movement to the non-operative position.

15. The yarn forming apparatus as defined in claim 11 or 12 wherein said attachment means comprises means for severing the binder strand upon pivotal movement to the non-operative position.

16. The yarn forming apparatus as defined in claim 12 wherein said hollow spindle includes a pair of radial openings adjacent the upstream end thereof, and such that the binder strand may be threaded therethrough so as to have a portion thereof disposed along the outside of said hollow spindle, and wherein said attachment means includes a brake pad mounted to said frame so as to operatively engage that portion of said hollow spindle adjacent said radial openings upon pivotal movement to the non-operative position.

17. The yarn forming apparatus as defined in claim 12 wherein said attachment means includes a brake arm mounted so as to operatively engage one of the feed rolls of said drive means downstream of said spindle upon its pivotal movement to the non-operative position and so as to clampingly engage the binder strand therebetween.

18. The yarn forming apparatus as defined in claim 10 wherein said control means further includes a pad fixedly mounted to said frame, and a cooperating clamping member mounted to one of said spindle assembly, said yarn feed means, and said yarn take-up means, and such that the binder strand is clamped therebetween upon pivotal movement to the non-operative position.

19. The yarn forming apparatus as defined in claim 10 wherein said control means further includes yarn severing means fixed to said frame at a location wherein the binder strand is moved into contact with said severing means during pivotal movement to the non-operative position.

20. The yarn forming apparatus as defined in claim 10 wherein said control means further includes brake pad means fixedly mounted to said frame for physically engaging the yarn take-up package to terminate the rotation thereof upon pivotal movement of said yarn take-up means to the non-operative position.

21. A method of forming a wrapped yarn composed of a core strand having a binder strand spirally wrapped thereabout, and comprising the steps of advancing a core strand along a path of travel and to a rotating take-up package, withdrawing a binder strand from a supply package and spirally wrapping the same about the advancing core strand to form a wrapped yarn, monitoring the advancing wrapped yarn to detect breakage of at least the core strand, and terminating the advance of the core strand and positively terminating the withdrawal of the binder strand from its supply package upon detection of the breakage of at least the core strand, so as to avoid undue winding of the binder strand on the take-up package upon a break occuring in the core strand.

22. The method as defined in claim 21 wherein the step of terminating the withdrawal of the binder strand from its supply package includes physically engaging the binder strand to preclude movement thereof.

23. The method as defined in claim 21 wherein the step of terminating the withdrawal of the binder strand from its supply package includes severing the binder strand.

24. The method as defined in claim 21 wherein the step of terminating the withdrawal of the binder strand from its supply package includes braking the take-up package so as to terminate the rotation thereof.

25. The method as defined in claim 21 wherein the core strand comprises staple fibers and the step of advancing the core strand along a path of travel includes drafting the core strand to reduce the density thereof prior to the binder strand being wrapped thereabout.

* * * * *